US005412913A

United States Patent [19]

Daniels et al.

[11] Patent Number: 5,412,913

[45] Date of Patent: May 9, 1995

[54] SELF-ALIGNING BEAM JOINT SUITED FOR USE IN MODULAR CONSTRUCTION

[75] Inventors: Harold F. Daniels, Tallahassee, Fla.; David M. Williams, Cincinnati, Ohio

[73] Assignee: Fluor Corporation, Irvine, Calif.

[21] Appl. No.: 68,650

[22] Filed: May 28, 1993

[51] Int. Cl.[6] ..... E04H 1/00

[52] U.S. Cl. ..... 52/79.13; 52/236.7; 52/236.9; 52/236.3; 52/266; 52/271; 52/637; 52/653.1; 52/655.1; 52/656.9; 52/726.3; 52/729; 52/745.03; 52/704; 52/712; 403/13

[58] Field of Search ..... 52/79.1, 79.9, 79.12, 52/79.13, 637, 657.01, 653.1, 655.1, 656.9, 726.1–726.4, 729, 745.03, 745.15–745.2, 266, 271, 236.3, 236.7, 236.8, 236.9, 704, 712; 403/13, 14, 405.1, 407.1

[56] References Cited

U.S. PATENT DOCUMENTS

| | | | |
|---|---|---|---|
| 964,233 | 7/1910 | Gilliland | 52/637 |
| 1,519,292 | 12/1924 | Castleman | 52/726.3 |
| 1,969,656 | 8/1934 | Marlowe | 52/637 X |
| 3,442,542 | 5/1969 | Watanabe | 52/726.3 X |
| 4,470,227 | 9/1984 | Bigelow et al. | 52/79.1 |
| 4,934,114 | 6/1990 | Lindsey | 52/637 X |

*Primary Examiner*—Carl D. Friedman
*Assistant Examiner*—Robert J. Canfield
*Attorney, Agent, or Firm*—Lyon & Lyon

[57] ABSTRACT

An improved joinder method and system which allow either individual vertical columns or prefabricated module assemblies which incorporate a plurality of said vertical columns to be quickly and accurately lowered into position on top of one or more similarly configured underlying columns. In one preferred embodiment the uppermost ends of the underlying columns comprise a portion of a similar previously installed module located immediately below the particular module being lifted into place. The improved columnar joint of the present invention can be utilized to automatically guide the prefabricated modules into proper location onto the uppermost ends of the underlying columns such that when the lowermost ends of the vertical columns being installed come to rest upon the uppermost ends of the underlying columns, the opposed ends of the vertical columns are sufficiently aligned with one another that they will readily support the weight of the module without any risk of shifting when the lifting tension is relieved. Self-aligning column joints of the present invention are also utilized to rigidly and permanently secure the vertically aligned column or columns to one another without the need to maintain any tension in the lifting device used to elevate the module into position once the lifting tension has been relieved. The method of the present invention may be employed to install a multiplicity of identical modules one on top of the other or to install a multiplicity of adjacent modules all at a given level within a structure without the need to utilize double support columns immediately adjacent one another where the adjacent modules fit together.

21 Claims, 5 Drawing Sheets

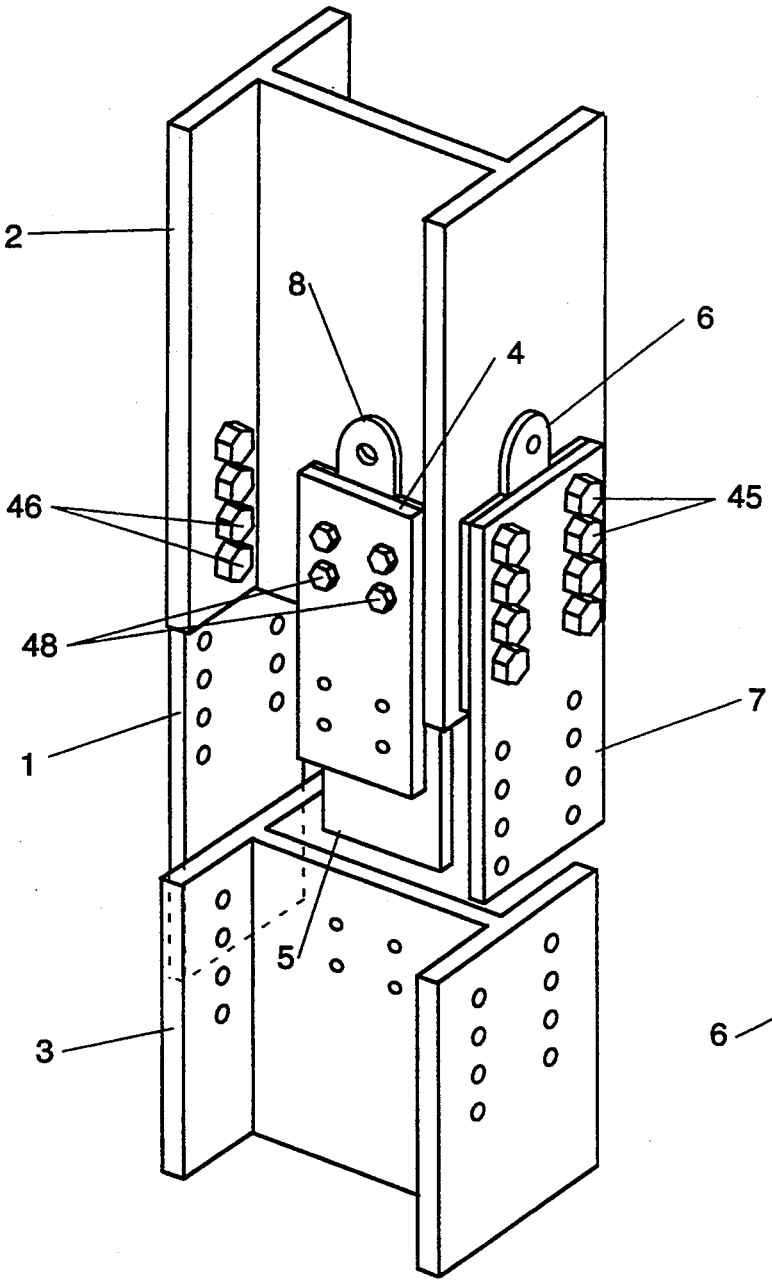
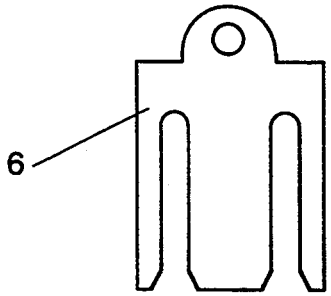
Fig. 1A
Fig. 1

SELF-ALIGNING BEAM JOINT SUITED FOR USE IN MODULAR CONSTRUCTION

TECHNICAL FIELD

The present invention relates to an improved method of erecting structural modules which can be assembled at ground level and hoisted into place on a building or other structure using a crane or other suitable lift means.

The present invention further relates to an improved joinder system which allows the structural modules to be quickly and accurately lowered into position onto a plurality of foundation columns or onto the uppermost ends of columns comprising a portion of a previously installed identical module located immediately below.

The present invention further relates to an improved columnar joint which can be utilized to automatically guide the modules into proper location onto the uppermost ends of the underlying columns such that when the lowermost ends of the particular columns comprising the module come to rest upon the uppermost ends of the columns of the underlying foundation or module, the opposed ends of the columns are sufficiently aligned that they will support the weight of the module without any risk of shifting when the tension is relieved from the lifting means.

The present invention further relates to the provision of such self-aligning column joints which can be utilized to rigidly and permanently secure the vertically aligned columns to one another without the need to maintain any tension in the lifting device used to elevate the module into position.

The improved self-aligning joints of the present invention may also, if desired, be utilized to speed the alignment and installation of individual vertical columns one-at-a-time.

BACKGROUND ART

Structural steel is commonly used to erect a wide range of architectural structures ranging from industrial buildings to industrial process platforms. Historically these structures have been built by hoisting individual beams into position one-at-a-time and thereafter cutting, fitting and securing them into permanent position.

Over the years, there have been numerous attempts to simplify the construction procedure utilizing techniques which allow more prefabrication and fitting together of the various structural steel members and floor sections at ground level.

Exemplary prior art patents addressing such simplified construction techniques are U.S. Pat. Nos. 4,330,970 to Bonink; 3,827,203 to Berrie; 3,378,971 to Singer et al.; 2,046,152 to Dean; 3,429,092 to Perry et al., 4,640,070 to Moffat; 3,788,024 to DeHartog; 3,942,297 to Kitagawa; and 4,965,974 to Lebow.

Most of the foregoing patents disclose columnar members having some type of mating joint member in a floor or roof member of a building such that a floor section can be lowered into position over an existing array of columns so that the columns will in one way or another interlock with the floor when the means utilized to lift the floor section into place releases the tension used for lifting.

In the case of U.S. Pat. No. 3,378,971 to Singer et al., the opposed ends of the columns are tapered, and each floor section includes a mating spigot on its uppermost and lowermost surfaces to effect a joint between the floor section and each column.

In the case of U.S. Pat. No. 4,965,974 to Lebow, the columns are provided with a horizontally extending plate at each end. The lowermost base plate is provided with one or more apertures, while the uppermost capital plate is provided with at least one upwardly extending pin. The pins and the apertures are laterally spaced from the column member and are positioned to be in register with a mating aperture or pin in a floor section or frame. Each floor section or frame has a top and bottom erection plate secured at its corners. The bottom erection plate has an aperture spaced from the frame members for receiving the pin from a capital plate of a column immediately therebeneath. The top erection plate has an upwardly projecting pin, which is received in registry by the aperture on a base plate of a column in the story or level immediately above it. Thus the structure disclosed by Lebow is assembled by positioning a first group of columns with a crane and thereafter lowering a prefabricated frame or floor into position on the tops of the first group of columns. Additional stories are added by successively positioning tiers of columns and frames or floor sections in like manner.

While systems of the type disclosed in the foregoing prior art patents have met with some degree of success, there has been a growing trend toward modular construction wherein entire modules, i.e., frames or floor sections with vertical columns rigidly secured thereto, are assembled at ground level and thereafter lifted into place as a unit. This is typically accomplished by extending the length of the vertical columns slightly below the frame or floor sections during the ground level prefabrication stage and thereafter securing the bottom ends of the columns on the particular module being lifted into position to the tops of the columns on the preexisting modular section which has been installed immediately below.

Columns employing tapered ends of the type disclosed by Singer et al. in U.S. Pat. No. 3,378,971 would not be particularly well suited for this purpose because they would require the use of a specially designed female connector which would secure two opposed tapered column ends to one another, but which would not weaken the resulting columnar structure. In addition, the use of such specially designed female connectors would make it more difficult to reliably and permanently secure the load carrying vertical columns to one another.

While horizontal plates employing transversely spaced mating pins and apertures such as those disclosed in U.S. Pat. No. 4,965,974 to Lebow have been utilized to secure a joint between the bottom of the columns on the module being installed and the top of the columns on the previously installed module located immediately below, the addition of these horizontally extending plates involves the addition of a considerable amount of steel. This additional steel is not necessary from a strength standpoint in the final structure and serves no purpose other than to aid alignment of the columns of each of the modules with one another during the assembly operation. It tends to therefore increase the cost of the resulting structure. In addition, the horizontally extending plates which are necessary in order for the mating pins and holes to be laterally offset from the columns tend to cause obstructions in the resulting building structure, particularly in the areas immediately adjacent the vertical columns. This in turn makes installation of final walls, routing of pipes, routing of conduits and the like in close proximity to the vertically extending columns employing joints of this type more difficult.

OBJECTS OF THE INVENTION

Accordingly, it is an object of the present invention to provide an improved joinder method and joint system which will permit easy, automatic alignment of the bottoms of the columns on a first module with the tops of the columns on a similar module or other foundation located immediately below.

It is another object of the present invention to provide such a method and system which is relatively inexpensive when compared to prior art systems, yet which is accurate and substantially self-aligning.

It is another object of the present invention to provide such a method and system wherein a multiplicity of horizontally adjacent modules can be installed at the same predetermined level using slight variations of this basic joinder method.

It is still another object of the present invention to provide an improved self-aligning joint which can be utilized to permit easier and faster installation of individual columns one-at-a-time.

DISCLOSURE OF THE INVENTION

The present invention provides method and apparatus for building and installing modular construction cells comprised of structural framework of the type normally utilized in buildings and processing structures. The modules are typically built at ground level either on site or at a remote location. The prefabricated modules are thereafter hoisted into position, typically at an elevated height, as a unitary structure. In a particularly preferred embodiment, the module is comprised of structural steel beams and includes at least one floor or frame member which rigidly secures a predetermined array of vertical steel beams to one another. If desired, process equipment, electrical and piping equipment, structural bracing and the like can be incorporated into each module prior to lifting it into place, thereby greatly speeding completion of construction after the module has been lifted into place. The columnar members, or in this case the vertical beams, of the module extend a predetermined distance below the floor or frame member and are intended to come to rest upon the tops of a corresponding array of vertical columnar members comprising either a foundation or the uppermost ends of a similar array of columns which are an integral portion of a previously installed module located immediately below the module being lifted into position.

Each vertical columnar joint formed between the bottoms of the first module and the tops of the preexisting module or other similarly configured underlying array of columns is preferably comprised of four splice plates which are positioned on four of the exposed surfaces of the beam in an array very similar to those used to splice adjacent beams to one another using conventional non-modular building construction techniques. In the case of an I-beam, two splice plates are located on the outermost surfaces of the flanges and two splice plates are located on the opposed surfaces of the web which connects the opposed flanges of the beam to one another. However, unlike conventional splice plates which are typically of the same length and which are normally installed after the beams have been vertically aligned with one another, the splice plates employed in a joint connection of the present invention are preinstalled on the bottom of each vertical column of the modular assembly before the modular assembly is lifted into position. In addition, each splice plate of the present invention extends below the bottom of each column by a different predetermined distance. This array of longest to shortest plates is identical for each column in the modular assembly.

A modular unit of the present invention is preferably lifted into position such that the innermost surface of the longest splice plates which are on the same outermost face of all of the vertical beams on the module first make contact with the corresponding outermost face of the preexisting vertical beams located immediately below. The innermost surface of the next longest web splice plates are then guided into their positions against the corresponding outermost surfaces on the preexisting vertical beams located immediately below. This process is repeated until the remaining two splice plates of each joint have passed below the top of the underlying beam. By using shims and/or spacers which can either be removed or permanently bolted into place, the telescopic joint thus formed tends to self-align the vertical column cross-sections with one another as the module is lowered into place and the bottom of the columns on the module come to rest on the tops of the underlying columns.

Once the module has been lowered into place such that the bottoms of the columns on the module being installed and the tops of the preexisting columns are in direct contact with one another, lifting tension on the module can be released since the module at this point is safely locked into place. Permanent securement of the extended splice plates at the joinder points may be performed later without the need to maintain tension on the lifting line for the module.

Adjacent modules can also be installed using a variation of this technique without the need to utilize double columns immediately adjacent one another to adequately support the adjacent module. Specifically, horizontally positioned angular clips can be provided on the outermost surfaces of the first module's columns. These clips will at least temporarily support the frame or floor member of the adjacent module even though no vertical columns are present at the edge of the adjacent module. Telescopic splice plate joints of the present invention need only be provided on the adjacent module to the extent they are needed to mate with those preexisting columns which align with the columns which do comprise a portion of the adjacent module. Thus, a portion of the weight of the adjacent module is at least temporarily supported by the horizontally extending portions of the angular clips provided on the outermost surfaces of the first module's columns.

The foregoing modular installation process can be repeated either vertically or horizontally as many times as necessary to rapidly and accurately construct whatever type of structure is ultimately desired.

BRIEF DESCRIPTION OF THE DRAWINGS

While the specification concludes with claims that particularly point out and distinctly claim the subject matter regarded as forming the present invention, it is believed that the invention will be better understood from the following detailed description with reference to the drawings in which:

FIG. 1 is an exploded simplified perspective view of a particularly preferred self-aligning column joint of the present invention;

FIG. 1A is a simplified view of a shim plate which can be utilized between the splice plates and the columns on self-aligning joints of the present invention to provide lateral tolerance and thereby aid in aligning the columns atop one another without causing interference;

DETAILED DESCRIPTION OF THE INVENTION

Figure 2:
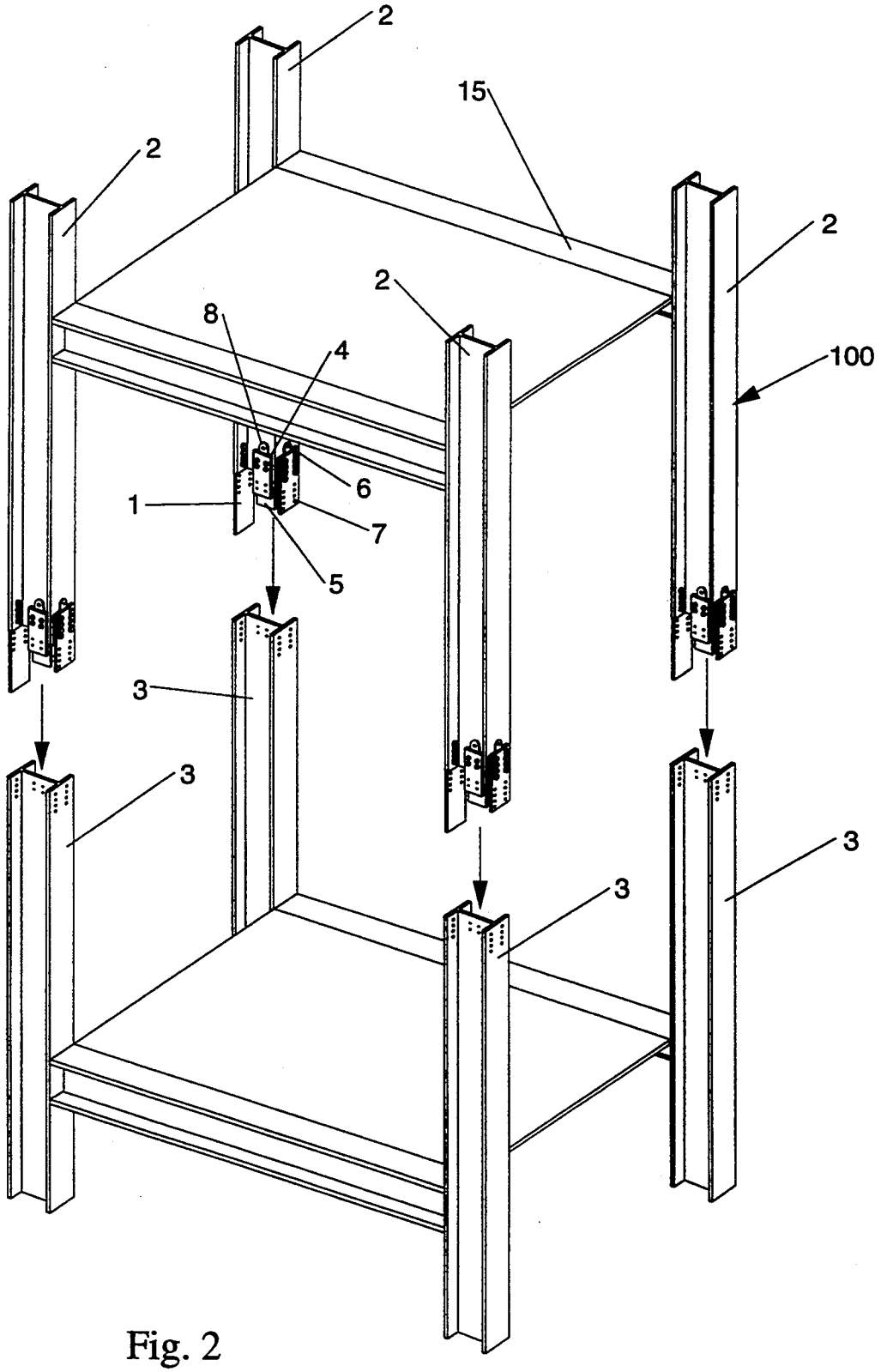
FIG. 2 is a simplified perspective illustration of a first module of the present invention being lowered into position onto a second similar module which has already been installed in its permanent position.

With reference to the Drawing Figures wherein like reference numbers are used to reference like parts, FIG. 1 illustrates in perspective the details of the splice connection in a columnar member section of a module assembly according to the present invention. This connection is made up of four splice plates 1, 4, 5 and 7 used to position the columnar members as the module is being lowered into place by a crane or other lifting device and to facilitate a secure splice between columnar members 2 and 3 once the module assembly 100, shown in FIG. 2, is lowered into its final position. All of the columnar members are preferably constructed of structural steel. I-beams are referred to herein as an exemplary preferred structural steel member for use in the present invention with the understanding that other structural steel members may likewise be used, e.g., rectangular tubing, angle iron, etc., depending upon the need for strength in a given application. The key requirement is that the cross-section of the vertical columns to be joined exhibit a sufficient number of exposed planar surfaces that the lowermost column is prevented from escaping from the boundary established by the splice plate extensions when the opposed ends of the columns make contact with one another. In the case of an I-beam, four splice plates are normally utilized. In the case of rectangular tubing, an opposed pair of angles could be utilized to form the joint if each leg of each angle is appropriately cut to length.

FIG. 2 illustrates a typical modular assembly 100 of the present invention as it would be before lowering into position for final bolt-up.

As best seen in FIG. 1 the extended splice plate connection assembly of the present invention would be initially fastened to the lowermost ends of each of the module assembly's columnar members 2.

In this example the four plates, 1, 4, 5 and 7 would be bolted or otherwise fastened to each columnar member 2 and used to accurately position each columnar member 2 over a corresponding columnar member 3 in the previously installed module located immediately below. The extended plate connection assembly would be bolted to each columnar member 2 before the module assembly 100, which in the illustrated embodiment is comprised of four columnar members 2 rigidly secured to a frame or floor section 15, is lifted into position with the crane. The long flange splice plate 1 would be fastened to columnar member 2 with any shims (not shown) necessary to compensate for reductions in columnar member size being installed between the long flange splice plate I and the columnar member 2. The bolts 45 and nuts 46 or other fastening devices would be installed and tightened to their final design torque. The short flange splice plate 7 would be fastened to columnar member 2 with any shims (not shown) necessary to compensate for reductions in columnar member size installed between short flange splice plate and the columnar member 2. The flange clearance shim, 6, shown in FIG. 1A, is preferably installed between the short flange splice plate 7 and the columnar member 2 to provide increased lateral clearance which allows the splice plates to easily pass below the top edges of the columns 3 without interference as the modular assembly 100 is lowered into place, as generally shown in FIG. 2. The bolts 45 and nuts 46 or other fastening devices securing splice plates 4 and 7 to column 2 would be made up hand tight only.

The long web splice plate 5 and the short web splice plate 4 would be fastened to the web of columnar member 2 with any shims (not shown) necessary to compensate for reductions in columnar member size being installed between splice plates 4 and 5 and the web. A web clearance shim 8 is preferably installed between the short web splice plate 4 and the web of the columnar member 2. The bolts 48 or other fastening devices would be made up hand tight.

This described assembly process of the extended splice plate connection assembly would be repeated on all other columnar members of the modular assembly 100 ensuring that the orientation of the long and short splice plates is the same on all columnar members 2.

After the extended splice plate connection assemblies are fastened to all of the columnar members 2 the module assembly 100 is ready for lifting into place. Using a crane or other suitable lifting device, the module assembly 100 is lifted and positioned over any previously installed module assemblies which are similar to modular assembly 100 or over any other structural steel assemblies having a similarly configured array of upwardly extending columnar members 3. Using the controls of the crane or lifting device and tag lines, if necessary, the module assembly 100 is preferably positioned approximately 8 to 12 inches laterally offset from the lower module or structural steel assembly comprising columnar members 3. This offset should be in the direction which positions the innermost surface of long flange splice plates 1 and the long web splice plates 5 away from the corresponding outermost surfaces on lower columnar members 3. The module assembly 100 should then be lowered to the elevation that places the bottom edge of the long flange splice plate 1 below the top edge of columnar member 3 while keeping the bottom edges of the other splice plates above the top edge of columnar member 3. Using the crane and any necessary tag lines, the module assembly 100 is then moved laterally so that the innermost surface of the long flange splice plate 1 contacts the outermost surface of the flange of columnar member 3. Next, each long web splice plate 5 is maintained in a position offset from the web of the corresponding columnar member 3 in the same direction that the original offset direction provided. The crane or other lifting devices continues lowering the module assembly 100 until the bottom of the long web splice plate 5 is below the top of columnar member 3. Using the crane and any necessary tag lines, module assembly 100 is then moved in the direction that brings the innermost face of long web splice plate 5 in contact with the outermost surface of the web of the columnar member 3. The module assembly 100 is maintained in this lateral position at all columnar member locations and the module assembly 100 is then lowered to its final position with the bottom of columnar members 2 coming into contact with the top of columnar members 3. At this point the module 100 will maintain its installed position even if lifting tension from the crane is released.

Bolts 45 and nuts 46 or other fasteners are installed in the bottom section of the long flange splice plate securing all of the long flange splice plates 1 to all of the corresponding flanges of columnar members 3. The previously installed bolts or fasteners in the short flange splice plate 7 and the web splice plates 4 and 5 can be loosened just enough to facilitate removal of the optional flange and web clearance shims 6 and 8, respectively. The typical slotted arrangement generally shown with respect to clearance shim 6 in FIG. 1A permits removal of the clearance shims 6 and 8 without entirely removing the bolts. The bolts and nuts or other fasteners can now be installed in the bottom sections of all remaining splice plates and all bolts or other fasteners can be tightened to their final design torque. This process is repeated on all extended plate connection assemblies for the entire modular assembly 100.

Figure 3:
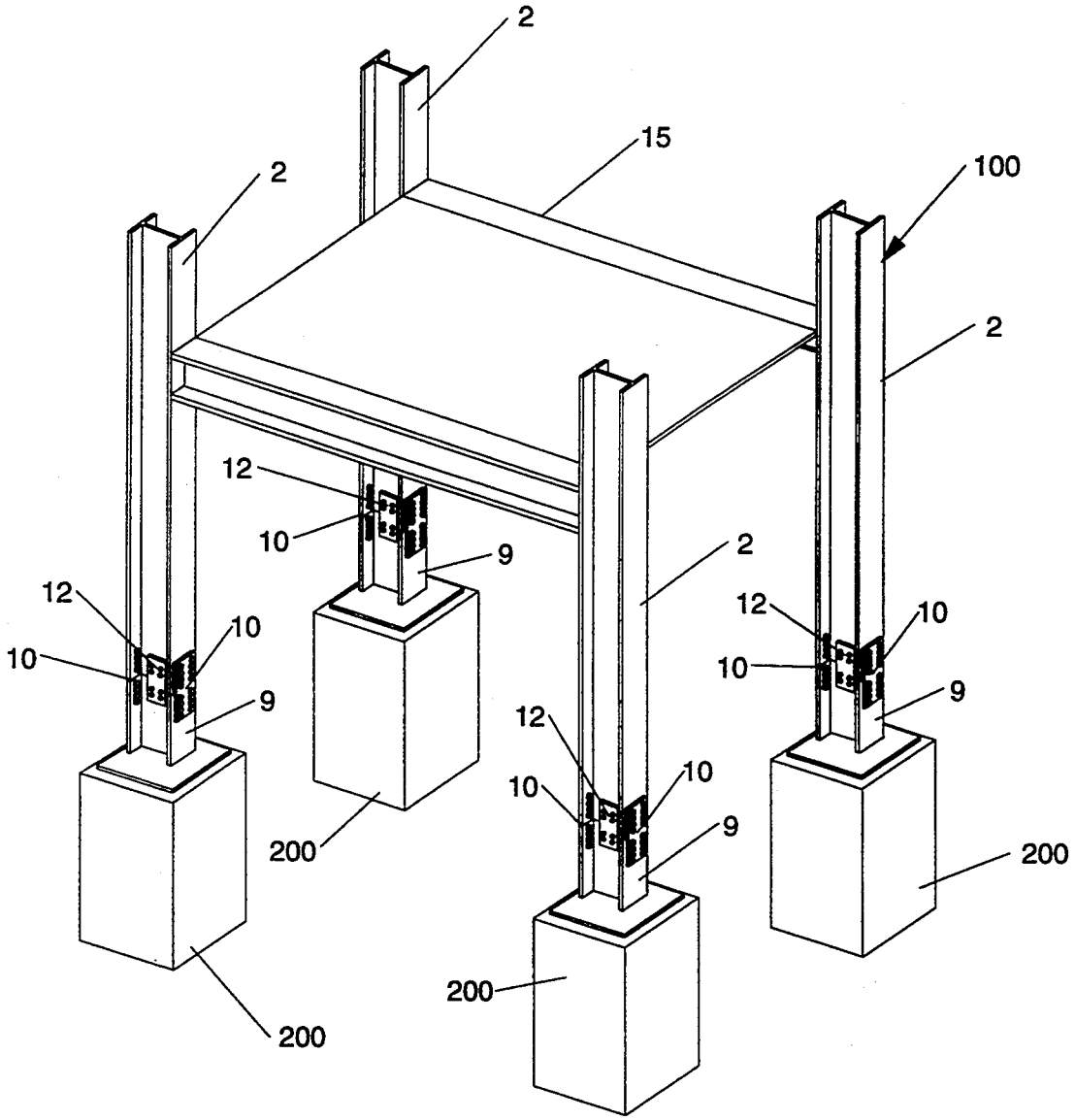
FIG. 3 is a simplified perspective illustration of a module of the present invention bolted onto a preexisting array of stub columns, such as might be utilized as a fabrication jig to ensure accurate alignment of the resulting prefabricated modules with one another.

To ensure correct alignment of the module assemblies 10 with other module assemblies or other structural steel assemblies having an array of upwardly extending columns 3, all modular assemblies 100 are preferably fabricated on stub columns 9, as generally shown in FIG. 3. These stub columns are accurately positioned to ensure the correct dimensioning of each module assembly 100. Accordingly they are set in foundations 200 at or below ground level so that the fabrication of all module assemblies 100 can be done at a convenient low height to facilitate quick and easy fabrication at ground level. By utilizing the same or identical sets of stub columns 9 for fabrication of the module assemblies 100, identicalization of the fit-up between sequentially fabricated module assemblies 100 is assured, i.e., it minimizes the mismatch of connections that can happen using other techniques. After the fabrication of each module assembly 100 is completed, the module assembly is unbolted from the stub column attachment plates 10 and 12, fitted with extended splice plates 1, 4, 5, 7 of the present invention and moved to the erection site or a suitable storage location until the module assembly is ready for lifting into position. Alternately, a set of extended splice plates 1, 4, 5 and 7 of the present invention may be utilized to secure each of the vertical columns 2 to the stub columns 9 during the module prefabrication process in lieu of the conventional splice plates 10 and 12 shown in FIG. 3.

Figure 4:
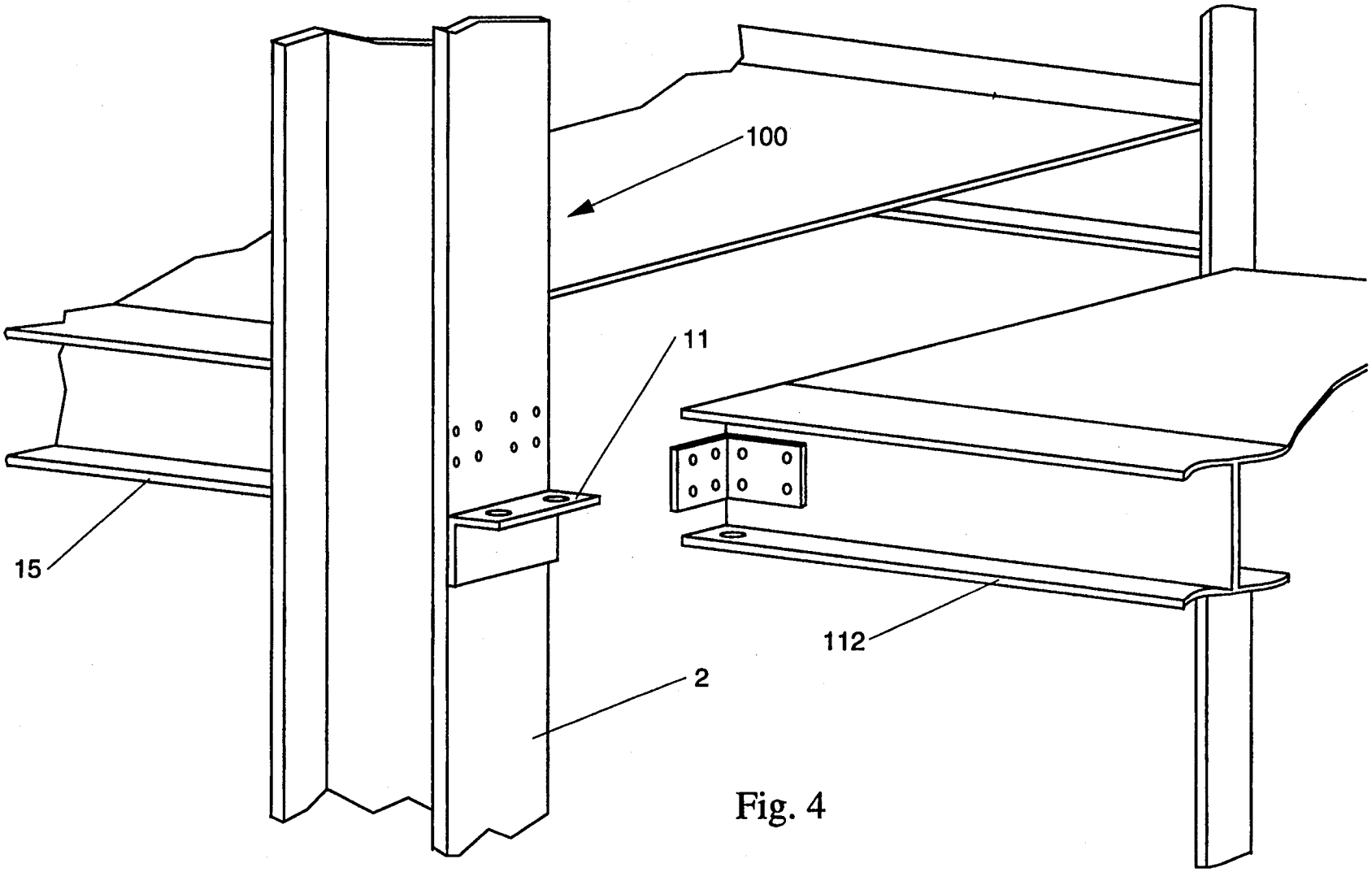
FIG. 4 is a partially exploded view of how adjacent modules of the present invention can be installed without the need to position two support columns immediately adjacent one another.

Structures designed to have modular assemblies that are horizontally adjacent can be constructed without the need for double column construction using a variation of the present invention. These structures would have the first modular assembly 100 at each level designed and fabricated as described earlier herein except that any shared columnar members 2 would have locating/supporting clips 11 attached to the column as depicted in FIG. 4. These locating/supporting clips 11 are preferably fabricated of structural steel, such as angle iron, and fastened to the columnar members 2 by welds, bolts or other fastening devices.

The locating/supporting clips 11 serve to vertically locate and temporarily support the beams which make up the frame or floor section 112 of the adjacent modular assembly during placement of the adjacent module. The permanent connection at this location will ultimately be provided by standard connection methods well known in the art and as generally shown in FIG. 4.

Figure 5:
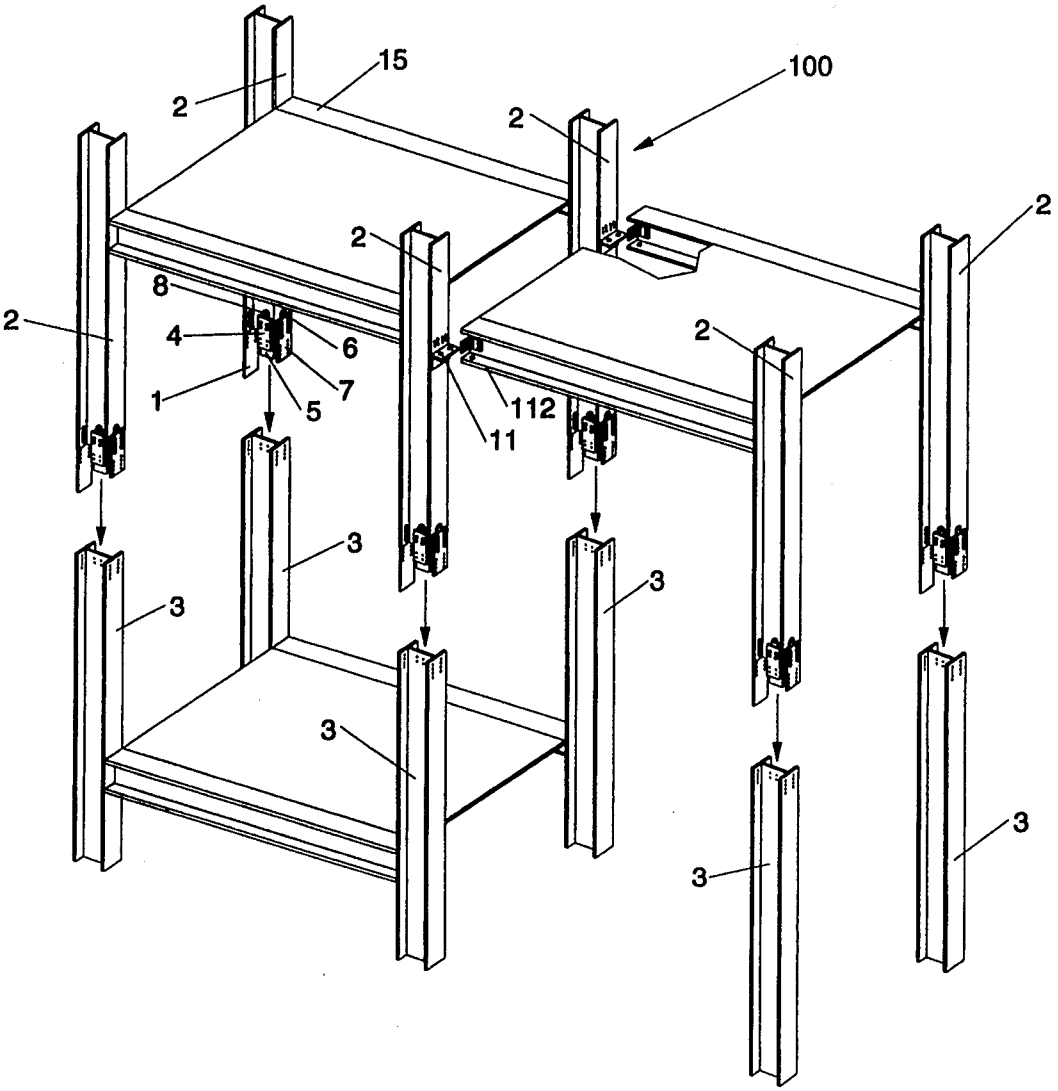
FIG. 5 is a partially exploded, partially cut-away view of how an adjacent two-legged module of the present invention might be installed next to a four-legged module of the present invention without the need to employ two support columns immediately adjacent one another in order to provide at least temporary vertical support to the horizontally extending frame member or floor section of the adjacent module at the point of butt-up.

As shown in FIG. 5, all subsequent adjacent modular assemblies at any one horizontal level would use this described locating/supporting clip detail at all shared columns. Where columnar members are not shared, the extended splice plate connection details as described previously are preferably employed.

While the present invention has been described in the context of equipping modular assemblies with a plurality of self-aligning joints of the present invention to facilitate lifting and positioning an entire modular assembly into position, it is recognized that individual vertical columns may advantageously employ these self-aligning joints to facilitate easier alignment and installation of individual vertical columns one-at-a-time. This technique may be of particular value where there is inadequate surrounding clearance or lifting capacity to handle entire modular assemblies. In addition, it will be obvious to those skilled in the art that various changes and modifications can be made to the method and system of the present invention without departing from the spirit and scope of the invention, and it is intended to cover in the appended claims all such modifications that are within the scope of this invention.

What is claimed is:

1. A self-aligning joint for coupling an end portion of a first structural member with an end portion of a second structural member, said joint comprising four splice plates secured to and each extending a different distance from said end portion of said first member, with at least one of said splice plates capable of being secured to said second structural member.

2. The joint of claim 1 wherein said first structural member comprises an I-beam having a pair of opposed flanges connected to one another by a web, said four splice plates are secured to said end portion of said first member, said splice plate extending the longest distance from said end portion of said first member is secured to one of said flanges, and said splice plate extending the shortest distance from said end portion of said first member is secured to said web.

3. The joint of claim 2 wherein a shim is at least temporarily secured between one of said splice plates and said web.

4. The joint of claim 3 wherein said shim is removable without completely detaching any of said splice plates from said first structural member.

5. The joint of claim 1 wherein at least one of said splice plates is bolted to said second structural member.

6. The joint of claim 5 wherein at least one of said splice plates is bolted to said first structural member.

7. A modular assembly comprising a floor frame and a plurality of support members coupled to said frame, a first of said support members having an end to which are secured a plurality of splice plates extending different distances from said end.

8. The assembly of claim 7 wherein said first support member comprises an I-beam having a pair of opposed flanges connected to one another by a web, at least four of said splice plates are secured to said end, said splice plate extending the longest distance from said end is secured to one of said flanges, and said splice plate extending the shortest distance from said end is secured to said web.

9. The assembly of claim 7 wherein said floor frame has a top and a bottom, and at least one of said support members extends both above and below said floor frame.

10. The assembly of claim 7 wherein a shim is at least temporarily secured between one of said splice plates and said web, and said shim is removable without completely detaching any of said splice plates from said first support member.

11. The assembly of claim 7 wherein at least one of said splice plates is bolted to a previously installed support member of a previously installed assembly.

12. The assembly of claim 11 wherein at least one of said splice plates is bolted to said first support member.

13. A method of joining an end portion of a first support member with an end portion of a second support member comprising:

securing a plurality of splice plates to said end portion of said first member such that each of said splice plates extends a different distance from said end;

sequentially juxtaposing each of said splice plates with a surface of said second support member; and securing at least one of said splice plates to said second support member.

14. The method of claim 13 wherein said first support member comprises an I-beam having a pair of opposed flanges connected to one another by a web, at least four of said splice plates are secured to said end portion of said first member, said splice plate extending the longest distance from said end portion of said first member is secured to one of said flanges, and said splice plate extending the shortest distance from said end portion of said first member is secured to said web.

15. The method of claim 14 further comprising temporarily placing a shim between one of said splice plates and said web.

16. The method of claim 15 further comprising removing said shim without completely detaching any of said splice plates from said first support member.

17. The method of claim 13 comprising bolting said splice plates to each of said first and second support members.

18. A method for building a structure from modular assemblies comprising:

constructing a first assembly having a plurality of first support members and a first floor frame;

constructing a second assembly having a plurality of second support members and a second floor frame;

securing a plurality of splice plates to an end of at least one of said support members such that each of said splice plates extends a different distance beyond said end;

installing said first assembly in a desired position;

lifting said second assembly above said first assembly; and lowering said second assembly onto said first assembly, sequentially juxtaposing each of said splice plates with a surface of a juxtaposed said support member.

19. The method of claim 18 wherein said support member to which are secured said splice plates comprises an I-beam in which a pair of opposed flanges is connected to one another by a web, at least four of said splice plates are secured to said end, said splice plate extending the longest distance from said end is secured to one of said flanges, and said splice plate extending the shortest distance from said end is secured to said web.

20. The method of claim 18 further comprising ceasing said lifting as soon as said second assembly comes to rest on said first assembly.

21. The method of claim 18 further comprising constructing both first and second assemblies before installing said first assembly.

* * * * *